United States Patent [19]

Neilsen

[11] 4,220,112

[45] Sep. 2, 1980

[54] WHEEL MOUNTED ALARM MECHANISM

[76] Inventor: Roger P. Neilsen, 2943 Hillegass, Berkeley, Calif. 94705

[21] Appl. No.: 974,371

[22] Filed: Dec. 29, 1978

[51] Int. Cl.[3] ..... A63C 17/26; B60Q 5/00

[52] U.S. Cl. ..... 116/56; 116/67 R; 280/11.19

[58] Field of Search ..... 116/56, 60, 61, 67 R, 116/95; 280/11.37 R, 11.19

[56] References Cited

U.S. PATENT DOCUMENTS

| | | | |
|---|---|---|---|
| 1,327,993 | 1/1920 | Goldblatt | 116/56 |
| 1,790,423 | 1/1931 | Hooks | 280/11.19 |
| 2,802,441 | 8/1957 | Epstein et al. | 116/56 X |
| 2,843,075 | 7/1958 | Geraghty | 116/67 R X |
| 3,302,954 | 2/1967 | Elwell | 116/56 X |
| 3,960,104 | 6/1976 | Van Tuyl | 116/56 X |
| 4,022,147 | 5/1977 | Hafstrom | 116/67 R |

*Primary Examiner*—Daniel M. Yasich
*Attorney, Agent, or Firm*—Bielen and Peterson

[57] ABSTRACT

An alarm mechanism associated with a wheel using a vibratory body. A striker is also included which is adapted for contacting the vibratory body. The striker and vibratory body are mounted such that the striker is rotatable in relation to the vibratory body and the striker or contacts the vibratory body during the revolution of the wheel.

3 Claims, 3 Drawing Figures

WHEEL MOUNTED ALARM MECHANISM

BACKGROUND OF THE INVENTION

The present invention relates to a novel wheel mounted alarm mechanism.

Moving objects often require alarm systems to warn others of their presence. For example, large trucks have alarm mechanisms which warn pedestrians and other vehicles of the fact that they are moving in a reverse direction, a direction in which the driver's acuity is hampered. Various other objects, especially wheel mounted ones, require alarm systems. This is especially true of the vehicles which are relatively quiet, fast moving, and which offer little protection for the user, eg: skateboards, scooters, bicycles, etc.

Prior alarms for wheeled vehicles have included the provision of mechanically or electrically operated sound emitting devices. Prior sound alarms have generally necessitated the provision of separate or isolated alarm systems. No known prior alarm mechanisms have successfully employed the kinetic energy generated by the wheeled vehicle to operate the same.

SUMMARY OF THE INVENTION

In accordance with the present invention a novel and useful wheel mounted alarm mechanism is provided.

The alarm mechanism of the present invention includes a vibratory body such as a plate, campanulum, bar, and the like. A striker is also provided for contacting the vibratory body. The combined vibratory body and striker form a sound producing unit in the audible range.

The invention also includes means for permitting the axial turning between the striker and the vibratory body with the axial rotation of the wheel relative to the axle. The striker and vibratory body contact each other during the revolution of the wheel. Such means may take the form of fixing of the striker and vibratory body in opposite configuration to one another on the wheel and axle. Thus, the rotation of the wheel will produce relative movement between the striker and vibratory body. It is anticipated that the striker may be fixed to the axle or the wheel and the vibratory body would be fixed to the axle or the wheel also, such that the striker and the vibratory body would resultingly be affixed one to the axle and the other to the wheel.

Such fixing means may take the form of a spacer such as a spring member. The spacer has a first end portion and a second end portion such that the first end portion engages the wheel and moves with the rotation of the wheel. The second end portion of the spring member engages means provided therefore. Such means may take the form of a plate which is movable with the turning of the wheel and the spring member. The striker or vibratory body may be affixed to this plate. The spring member may be urged toward engagement with the wheel by means adapted for forcing together or compressing the wheel, spring member, and the plate. Such forcing means may take the form of an elongated member having a threaded portion. Likewise, the axle may include a threaded portion for threading engagement with the threaded member. Thus, the threading engagement heretofore described would cause the compression of the plate, spring member, and the wheel.

In addition, the vibratory body or the striker is affixed to a portion of the elongated threaded member such that the striker and vibratory body contact one another during the axial rotation of the wheel. The plate may contain a raised portion for confining the end portion of the spring member. The other side of the plate would provide an area for fixation of the vibratory body or the striker heretofore described. A bearing may be interposed the plate and the threaded member. Thus, the wheel turning moves either the vibratory body or the striker while the remaining element of the sounding unit, ie: the vibratory or the striker not fixed to the wheel, is mounted to the axle of the wheel. Simple relative movement between the axle and the wheel creates a sound alarm.

It may be apparent that a new and useful wheel associated alarm mechanism has been described.

It is therefore an object of the present invention to provide an alarm mechanism associated with a wheel and axle which may be easily adaptable to mounting on the same.

It is another object of the present invention to provide an alarm mechanism associated with a wheel and axle which employs the kinetic energy of the moving body associated with the wheel and axle to produce a sound alarm.

Another object of the present invention is to provide an alarm mechanism associated with a wheel and axle which is readily adaptable to a skateboard.

Yet another object of the present invention is to provide an alarm mechanism associated with a wheel and axle that does not interfere with the movement of the wheel and axle and produces a readily perceivable alarm signal.

The invention possesses other objects and advantages especially as concerns particular features and characteristics thereof, which will become apparent as the specification continues.

Figure 1:
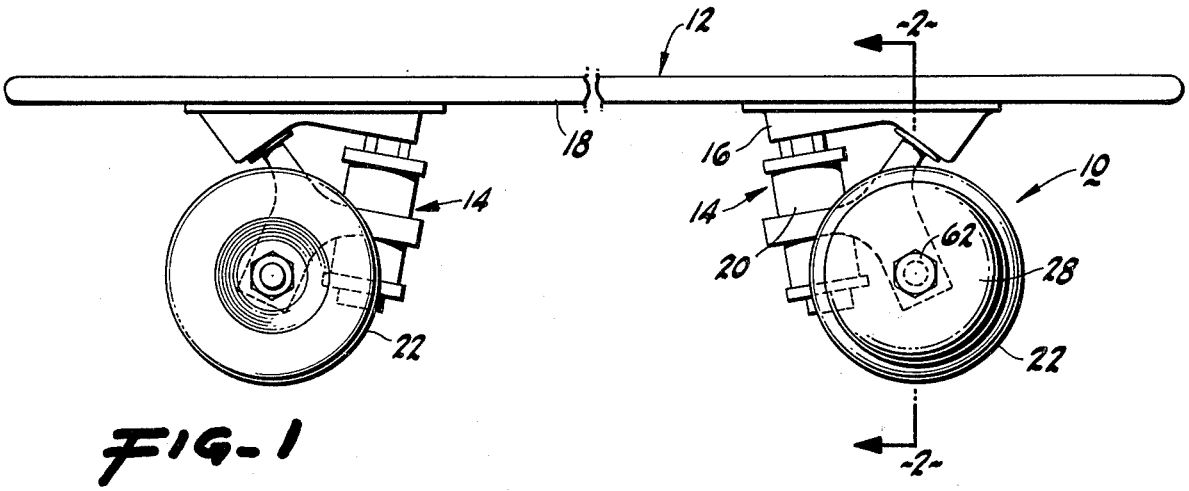
FIG. 1 is broken side elevational view depicting the right side and left side of a wheel mounted body employing the mechanism of the present invention.

For a better understanding of the invention, references made to the following detailed description.

DESCRIPTION OF THE PREFERRED EMBODIMENTS

Various aspects of the present invention will evolve from the following detailed description of the preferred embodiments thereof which should be taken in conjunction with the heretofore described drawings.

With reference to the Figures the mechanism as a whole is indicated by reference character 10. Mechanism 10 may be employed with a wheel mounted body 12 having at least one wheel system 14. Wheel system 14 includes a support member 16 fixed to platform 18 which normally supports the load being transported by the wheel mounted body 12. Although the mechanism 10 of the present invention would applicable to various wheel and axle mechanism, it is shown in the drawings as being associated with a wheel system 14 typically associated with a skateboard. As such, the wheel system 14 also includes a shock absorber 20, known in art of skateboard manufacturing. The wheel system 14 includes a wheel 22 having an axle 24, wheel 22 being movable relative to axle 24, FIGS. 1 and 2.

Figure 2:
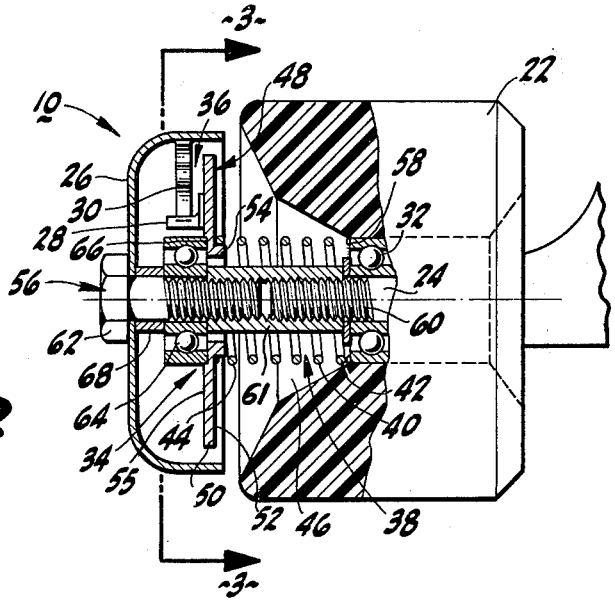
FIG. 2 is a view taken along line 2—2 of FIG. 1, having a broken away portion.
Figure 3:
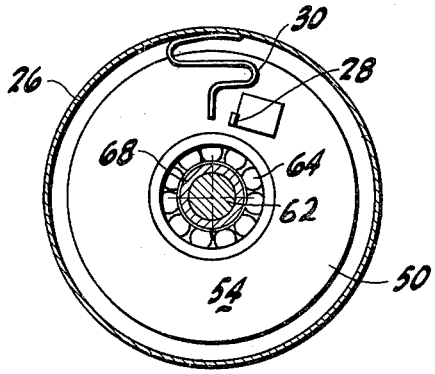
FIG. 3 is a view taken along line 3—3 of FIG. 2.

The alarm mechanism 10 further includes a vibratory body 26, depicted in FIGS. 1, 2 and 3 as a bell-shaped member. Vibratory body 26 may be constructed of metal, plastic, or any other sound producing material. A striker 28 is mounted for contacting chime 30 during revolution of wheel 22 about axle 24. It should be noted that bearing 32 permits the relative movement between wheel 22 and axle 24.

Means 34 permits the axial turning between striker 28 and vibratory body 26 commensurate with the axial rotation of wheel 22 about axle 24. Means 34 may be viewed as means for fixing vibratory body 26 and striker 28 in an opposed configuration with respect to one another on the wheel and axle. In other words, striker 28 may be affixed to axle 24 or wheel 22 while vibratory body 26 would correspondingly be affixed to wheel 22 or axle 24. The combination of the vibratory body and striker would form a signal producing unit 36 which would generate an audible signal. It should be realized, however, that the contact between the vibratory body and the striker could produce other types of alarm signals such as a flashing light signal, an electrical jolt signal and the like perceivable by one of the senses. Means 38 for selectively fixing the vibratory body and striker in opposed configuration with respect to one another on the wheel and axle may include a spacer 40 illustrated as a helical spring. Spring 40 has a first end portion 42 and a second end portion 44. First end portion 42 of spring 40 is adapted for engaging wheel 22 within recess 46. Spring 40 engages wheel 22 such that spacer 40 moves with the axial rotation of wheel 22. Second end portion 44 of spring 40 contacts means 48 for engaging the same. Means 48 may include a movable element 50 in the form a plate. Plate 50 includes a first side 52 which has a raised portion 54 for stabilizing second end portion 44 of spring 40. The other side 54 of plate 50 provides a mounting surface for striker 28.

The mechanism 10 also includes means 56 for forcing together wheel 22, spring member 40, and plate 50. By this expedient, first and second end portions 42 and 44 of spring 40 frictionally engage surface 52 of plate 50 and that portion of wheel 22 within recess 46, respectively. It should be noted, that spring 40 includes a flattened end portion 58 to aid in the heretofore frictional engagement between first end portion 42 and wheel 22. Means 56 may take the form of providing axle 24 with a threaded portion 60. Likewise, an elongated internally threaded member 61 is provided for threading engagement with threaded portion 60 of axle 24 and threaded member 62. Threaded member 62 bears on vibratory body 26 such that chime 30 aligns with striker 28. A bearing 64 fits within a recess 66 found on side 54 of plate 50. A bushing 68 positions bearing 64 such that there is relative movement between the combined threaded member 62 and axle 24 internally threaded member 61 and the combined plate 50, spring 40, and wheel 22. In the embodiment depicted in the drawings, wheel 22, spring 40, plate 50 and striker 28 rotate with the movement of body 12. Further, axle 24, internally threaded member 61, threaded member 62, vibratory body 25, and chime 30 are free from rotation with wheel 22 by dint of bearings 32 and 64. Thus, the turning of wheel 22 creates relative movement between chime 30 and striker 28 which generally produces an audio signal with each revolution of wheel 22. In the embodiment depicted in the drawings, wheel 22, spring 40, plate 50 and striker 28 rotate with the movement of body 12. Further, axle 24, internally threaded member 61, threaded member 62, vibratory body 26, and chime 30 are free from rotation with wheel 22 by dint of bearings 32 and 64. It should be noted that chime 30 may take the form of a high spot within vibratory body 26 and striker 28 may be lengthened with the advent of centrifugal force such that striker 28 only strikes chime 30 above a certain rotational speed of wheel 22.

In operation the user merely threads threaded member 62 onto axle 24 such that striker 28 aligns with chime 30. Rotation of wheel 22 will produce a signal which serves as an alarm that body 12 is moving.

While in the foregoing specification embodiments of the invention have been set forth in considerable detail for the purposes of making a complete disclosure of the invention, it will be apparent to those of ordinary skill in the art that numerous changes may be made in such details without departing from the spirit and principals of the invention.

What is claimed is:

1. A portable alarm mechanism associated with a wheel being movable in relation to a bearing supported axle comprising:

a. vibratory body including projecting means;

b. striker means for contacting said projecting means of said vibratory body, said vibratory body and striker comprising a signal producing unit; and c. a plurality of concentric means including first elongated spacer means and second elongated threaded means for permitting axial turning between said striker means and said vibratory body with the axial rotation of the wheel, said first elongated spacer means comprising a spring spacer having a first end portion and a second end portion, said first end portion of said spring spacer engaging the wheel for movement therewith, an element having a first side and a second side, said first side of said element frictionally engaging said second end portion of said spring spacer for movement therewith, said second elongated threaded means adjustably connected at one end thereof to the axle of the wheel, a bearing interposed said element and the other end of said second elongated threaded means, said vibratory body and said striker means being adjustably fixed to said second elongated threaded means and said second side of said element such that said striker means and said projecting means of said vibratory body contact each other during revolution of the wheel.

2. The alarm mechanism of claim 1 in which said element comprises a plate having a raised portion on one side thereof corresponding to said first side of said element for confinement of said second end portion of said spring spacer.

3. The alarm mechanism of claim 2 in which said vibratory body is adjustably fixed to said second elongated threaded means by a threaded body which threadingly engages said second elongated threaded means.

* * * * *